US008628036B2

(12) United States Patent
Jackson

(10) Patent No.: US 8,628,036 B2
(45) Date of Patent: Jan. 14, 2014

(54) TUB GRINDER

(75) Inventor: Richard A. Jackson, Weldon, IA (US)

(73) Assignee: JASE Corporation, Welden, IA (US)

( * ) Notice: Subject to any disclaimer, the term of this patent is extended or adjusted under 35 U.S.C. 154(b) by 48 days.

(21) Appl. No.: 13/452,554

(22) Filed: Apr. 20, 2012

(65) Prior Publication Data

US 2013/0277474 A1 Oct. 24, 2013

(51) Int. Cl.
*B02C 13/00* (2006.01)

(52) U.S. Cl.
USPC ..... 241/195; 241/101.761; 241/186.4; 241/189.1; 241/73

(58) Field of Classification Search
USPC ..... 241/73, 101.761, 185.5, 186.4, 189.1, 241/190, 191, 195
See application file for complete search history.

(56) References Cited

U.S. PATENT DOCUMENTS

| | | | | |
|---|---|---|---|---|
| 3,912,175 | A | 10/1975 | Anderson | |
| 3,966,128 | A | 6/1976 | Anderson et al. | |
| 4,033,515 | A | 7/1977 | Barcell et al. | |
| 4,066,216 | A * | 1/1978 | Waldrop et al. | 241/190 |
| 4,134,554 | A | 1/1979 | Morlock | |
| 4,210,289 | A | 7/1980 | Arnoldy | |
| 4,773,601 | A * | 9/1988 | Urich et al. | 241/101.761 |
| 4,846,411 | A | 7/1989 | Herron et al. | |
| 5,207,391 | A * | 5/1993 | Anderson | 241/186.4 |
| 5,419,502 | A | 5/1995 | Morey | |
| 5,626,298 | A | 5/1997 | Arnoldy | |
| 5,878,968 | A * | 3/1999 | Anderson et al. | 241/186.4 |
| 6,412,715 | B1 | 7/2002 | Brand et al. | |

* cited by examiner

*Primary Examiner* — Dana Ross
*Assistant Examiner* — Leonel Vasquez
(74) *Attorney, Agent, or Firm* — Sturm & Fix LLP

(57) ABSTRACT

A tub grinder has a rotor with hammers that pass between adjacent slug bars. The slug bars have a riser bar portion disposed on the top of the slug bars, the riser bar portions extending vertically higher on one end of each respective slug bar than on the other end of each respective slug bar so that the hammers extend farther beyond the top of the riser bar and slug bar when they pass by first end than when they pass by the second end of the riser bar.

6 Claims, 6 Drawing Sheets

EASY

TUB GRINDER

TECHNICAL FIELD

This invention relates generally to tub grinders and more particularly to an improvement to the slug bars of tub grinders.

BACKGROUND

Grinders for grinding hay or other materials to be ground are shown in U.S. Pat. Nos. 3,912,175 to Anderson, 3,966,128 to Anderson et al., 4,033,515 to Barcell et al., 4,134,554 to Morlock, 4,210,289 to Arnoldy, 4,846,411 to Herron et al., 5,419,502 to Morey, 5,626,298 to Arnoldy, and 6,412,715 to Brand et al., all of which are incorporated herein by reference in their entirety.

Tub grinders are used to reduce the size of many things such as bales of hay, tree branches, material from demolished buildings, etc. The material is placed in the top of the "tub" portion, for example with a grappling hook or front end loader on a tractor, then the tub portion rotates around a floor as can be seen in the prior art shown in FIG. 1 of the drawings. An opening in the floor as shown in prior art FIGS. 1 and 2 is provided with rotating hammers passing between slug bars, the hammers hitting the material in the tub, reducing the size to smaller particles that are delivered to an unloading conveyor to put the ground up particles in a pile or on a trailer or the like for transporting the ground material to another place. Typically the material to be ground is moving in the direction of the tub as shown by the arrow in FIG. 1, while the hammers are rotating in the direction shown in FIG. 1.

One of the problems associated with tub grinders is that they do not operate at optimum efficiency for all types of material to be ground.

Accordingly a tub grinder that can be easily adapted to efficiently grind different types of material is needed.

BRIEF DESCRIPTION OF THE DRAWINGS

The above needs are at least partially met through provision of the apparatus described in the following detailed description, particularly when studied in conjunction with the drawings, wherein.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
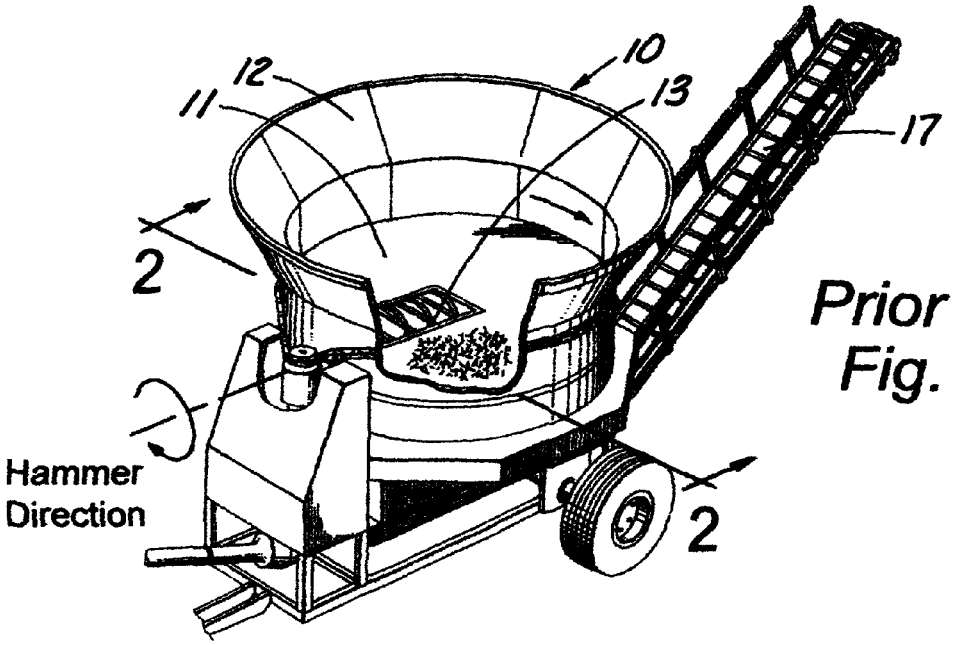
Prior Art Fig. 1
FIG. 1 is a typical prior art tub grinder.
Figure 2:
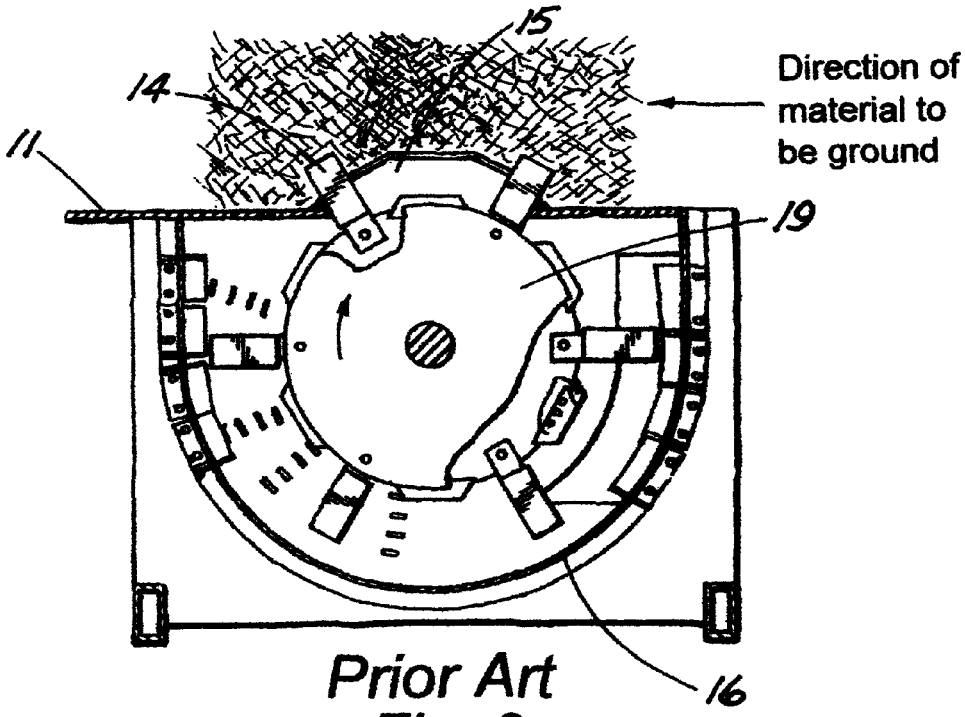
Prior Art Fig. 2
FIG. 2 is a cross sectional view taken along line 2-2 of the prior art device of FIG. 1.

Referring now to the drawings, wherein like reference numerals indicate identical or similar parts throughout the several views, FIGS. 1 and 2 show a typical tub grinder 10 without the improvements of the present invention thereon and explained in the third paragraph above. The tub grinder 10 has a floor 11 that is fixed with respect to the frame of the tub grinder 10. A rotating wall 12 is provided for moving the material within the walls of the tub wall 12 in the same general direction that the tub wall 12 is moving in order to move the material to a hammer mill 13 disposed in an opening in the floor of the tub grinder 10. Rotation of the rotor 19 and hammers 14 in the direction shown in FIG. 2 between slug bars 15 forces material above the floor 11 down into the area above screen 16 and the hammers also force the material through the screen 16 so that the ground up material can eventually be delivered to the unloading conveyor 17 for dumping the ground up material on the ground or into a trailer or wagon or the like.

Figure 3A:
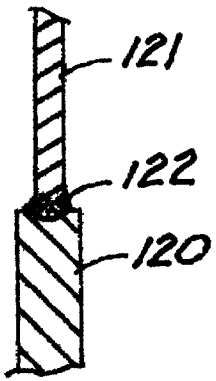
FIG. 3 is a side elevational view of a slug bar with one preferred configuration of a riser bar welded to the top thereof and immediately above that integral structure is shown the riser bar alone, before it is welded onto the slug bar.
Figure 3:
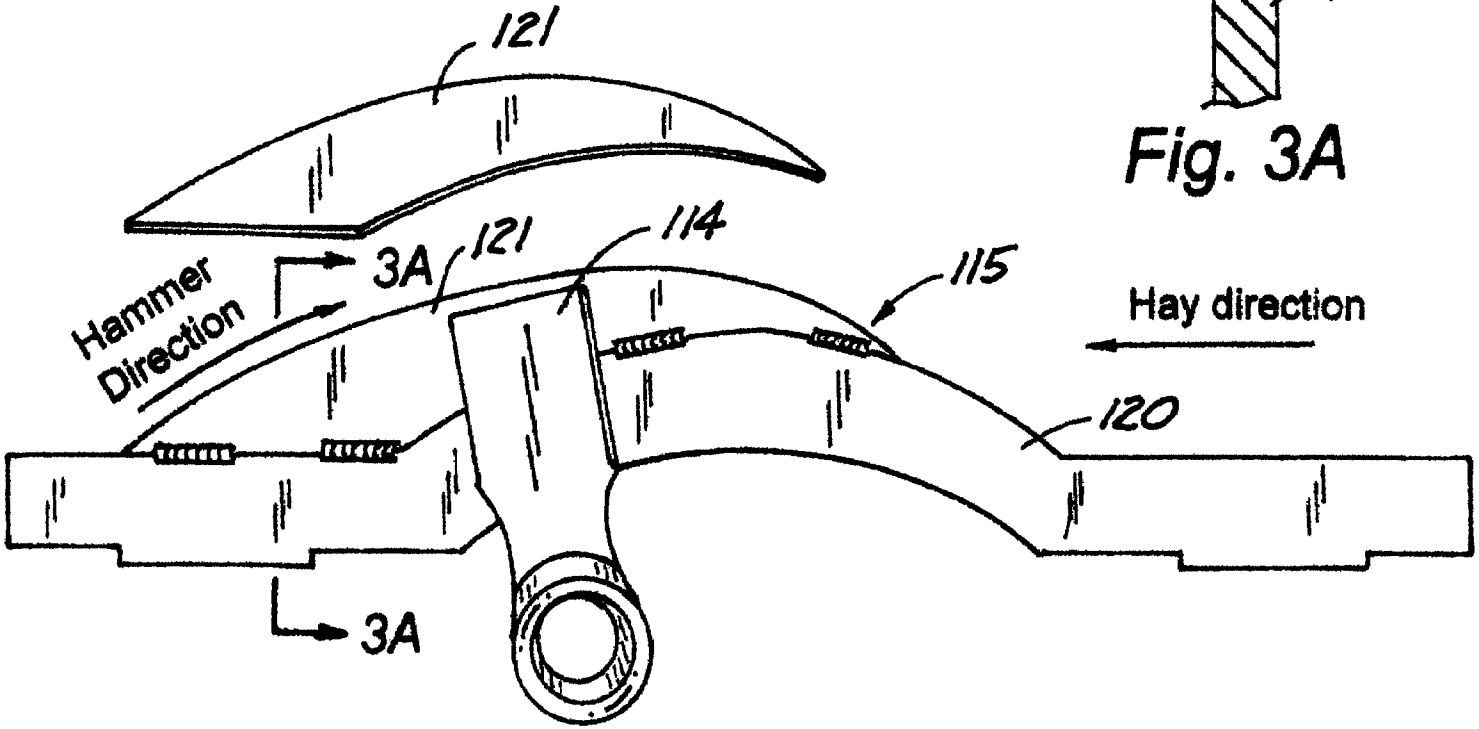

FIG. 3 is a side elevational view of a slug bar 115 with one preferred configuration of a riser bar 121 welded by welds 122 to the top of prior art part 120 thereof as shown in FIG. 3A, and immediately above that integral slug bar structure 115 in FIG. 3 is shown the riser bar 121 alone, before it is welded onto the prior art slug bar 120.

Figure 4A:
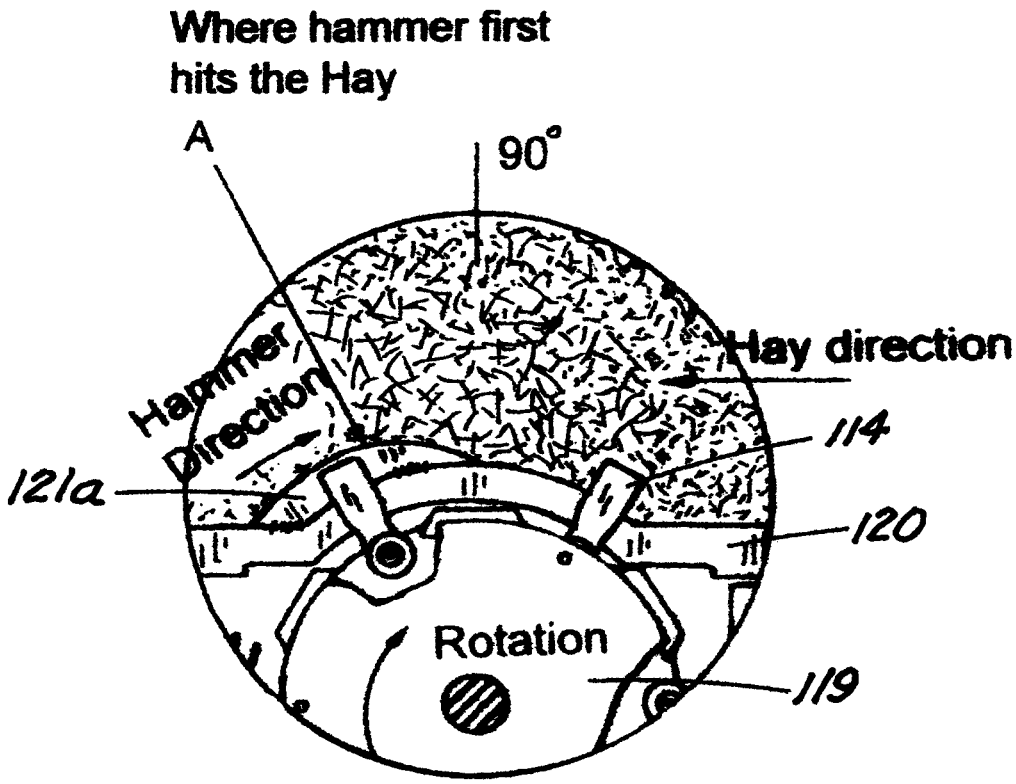
FIG. 4A is a cross sectional view similar to the prior art view of FIG. 2, but showing a preferred embodiment of the present invention set up for grinding material that is relatively easy to grind.

FIG. 4A is a cross sectional view similar to the prior art view of FIG. 2, but showing a preferred embodiment of the present invention set up for grinding material that is relatively easy to grind, such as very dry or light porous material such as alfalfa hay or Styrofoam. The rotor 119 is rotated in the direction shown by the arrow in FIG. 4A and the swinging hammers 114 do not hit the material to be ground as the hammers 114 first rotate upwardly between the slug bars 120 and riser bar portions 121*a* until about point A on the riser bar portion 121*a*. After that the hammers 114 gradually extend above the riser bar portions 121*a* more until they are only extending above the slug bars 120.

Figure 4B:
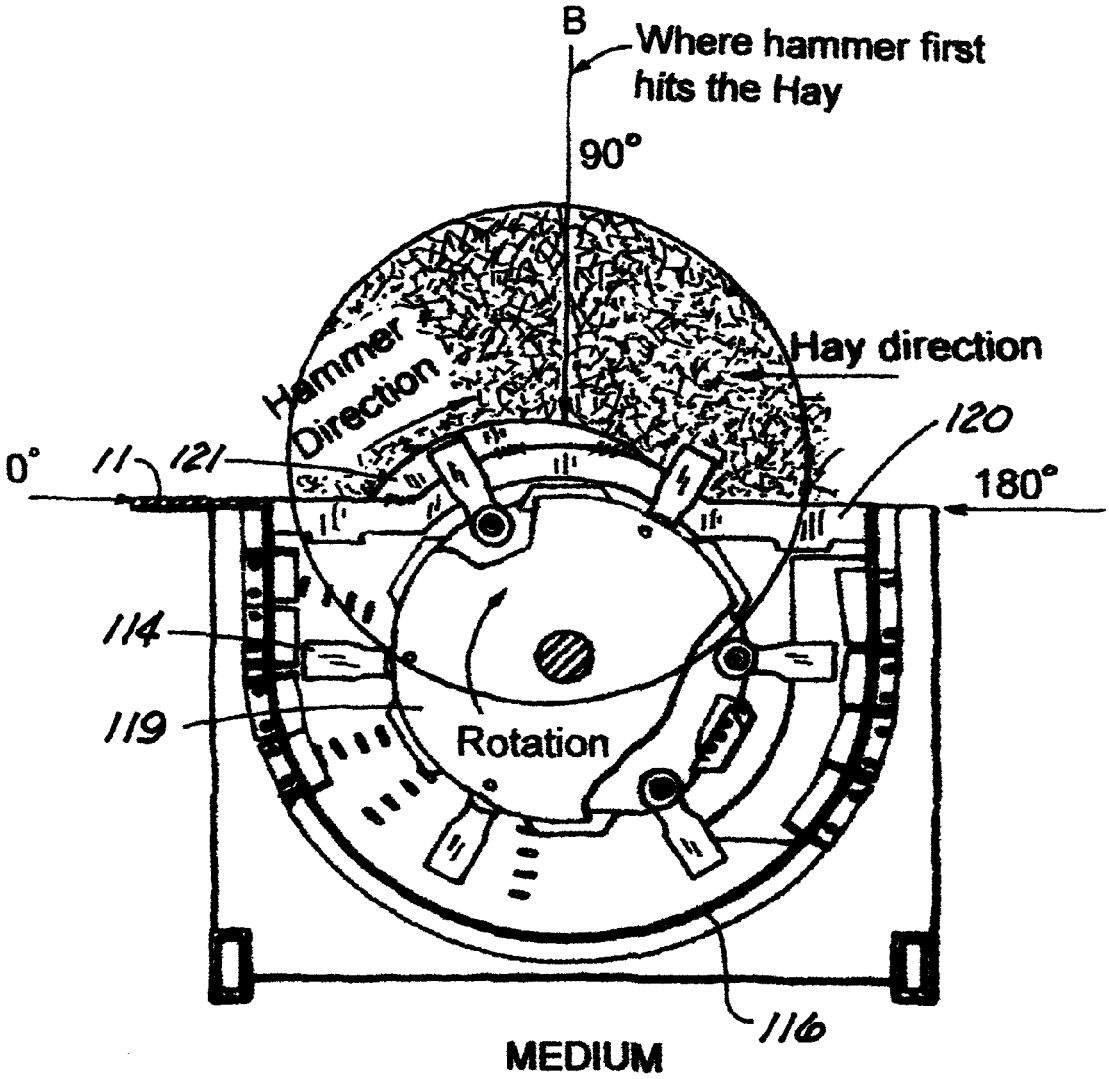
FIG. 4B is a cross sectional view similar to the prior art view of FIG. 2, but showing a preferred embodiment of the present invention set up for grinding material that is more usual or medium to grind.

FIG. 4B is a cross sectional view similar to the view of FIG. 4A, but showing a preferred embodiment of the present invention set up for grinding material that is average or medium to grind, such as wet or dense material like high moisture hay or fescue hay or medium porous material or the like. The rotor

119 is rotated in the direction shown by the arrow in FIG. 4B and the swinging hammers 114 do not hit the material to be ground as the hammers 114 first rotate upwardly between the slug bars 120 and riser bar portions 121 until about point B on the riser bar portion 121. After that the hammers 114 gradually extend above the riser bar portions 121*a* more until they are only extending above the slug bars 120. Since the riser bar portion 121 is longer an higher for more of the length of the riser bar 121 than for the riser bar portion 121*a* in FIG. 4A, the hammers 114 only extend above the riser bar portions 121 starting at point B where the hammer is substantially vertically oriented, therefore since the hammers 114 extend above the riser bars for less time and do not extend above the riser bars as far during such relative time, a less aggressive approach is taken which requires less horsepower to rotate the rotor 119 and doesn't slow the revolutions per minute (rpm) as much as if the same medium to grind material was in the tub grinder arrangement shown in FIG. 4A. Keeping the rpm of the rotor 119 (and therefore the rpm of an engine that rotates the rotor 119) above a certain predetermined level is important to the efficiency of a tub grinder and also reduces the wear and tear on such equipment such as the engine powering the tub grinder.

The hammers 114 force the material through the screen 116 similar to FIG. 2.

Figure 4C:
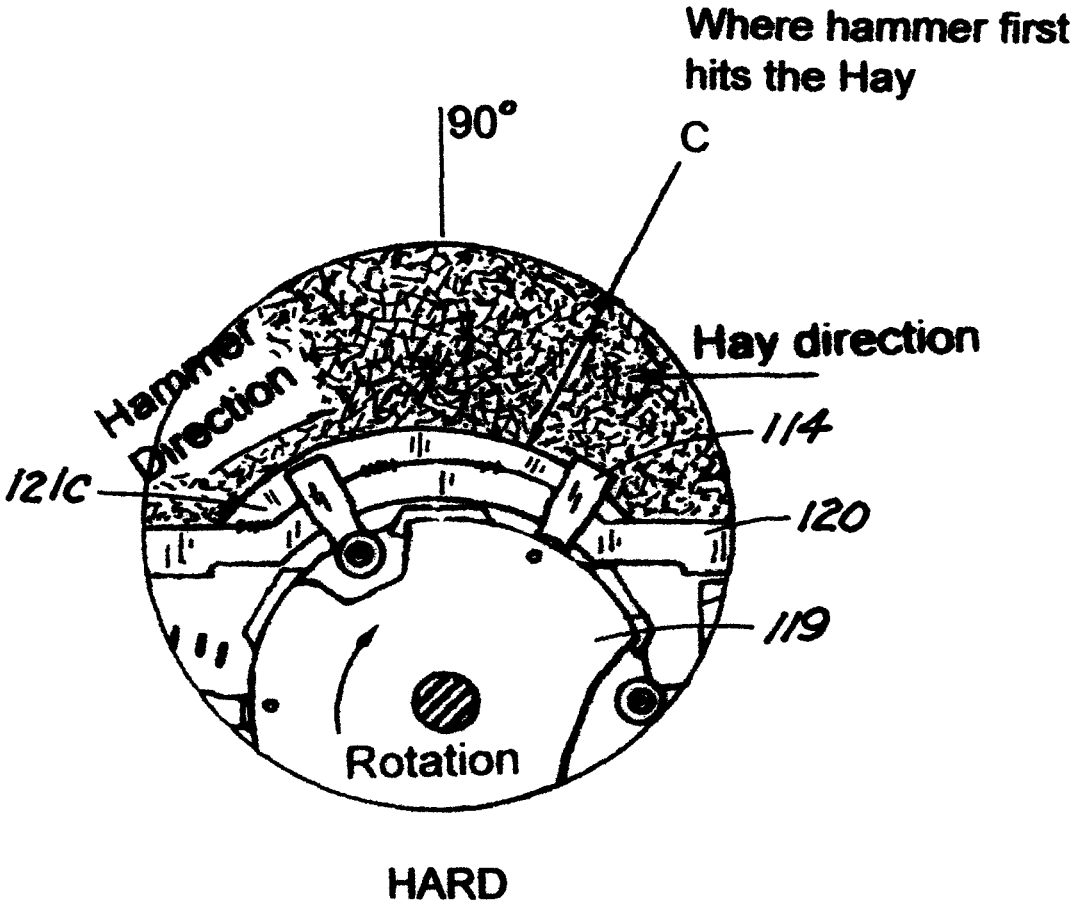
FIG. 4C is a cross sectional view similar to the prior art view of FIG. 2, but showing a preferred embodiment of the present invention set up for grinding material that is difficult or hard to grind.

FIG. 4C is a cross sectional view similar to the view of FIGS. 4A and 4B, but showing a preferred embodiment of the present invention set up for grinding material that is difficult or hard to grind, such as very dense material like wood, rubber, rubber tires or the like. The rotor 119 is rotated in the direction shown by the arrow in FIG. 4C and the swinging hammers 114 do not hit the material to be ground as the hammers 114 first rotate upwardly between the slug bars 120 and riser bar portions 121*c* until about point C on the riser bar portion 121*c*. After that the hammers 114 gradually extend above the riser bar portions 121*c* more until they are only extending above the slug bars 120. Since the riser bar portion 121*c* is longer an higher for more of the length of the riser bar 121*c* than for the riser bar portion 121*a* in FIG. 4A or riser bar portion 121 of FIG. 4B, the hammers 114 only extend above the riser bar portions 121 starting at point C where the hammer 114 is substantially past vertically oriented, therefore since the hammers 114 extend above the riser bars 121*c* for less time than when riser bars 121 or 121*a* are used and do not extend above the riser bars 121*c* as far during such relative time, a less aggressive approach is being taken than when the riser bars 121 or 121*a* are used, which requires less horsepower to rotate the rotor 119 and doesn't slow the revolutions per minute (rpm) as much as if the same easy to grind or medium to grind material was in the tub grinder arrangement shown in FIG. 4A or FIG. 4B respectively.

Figure 5:
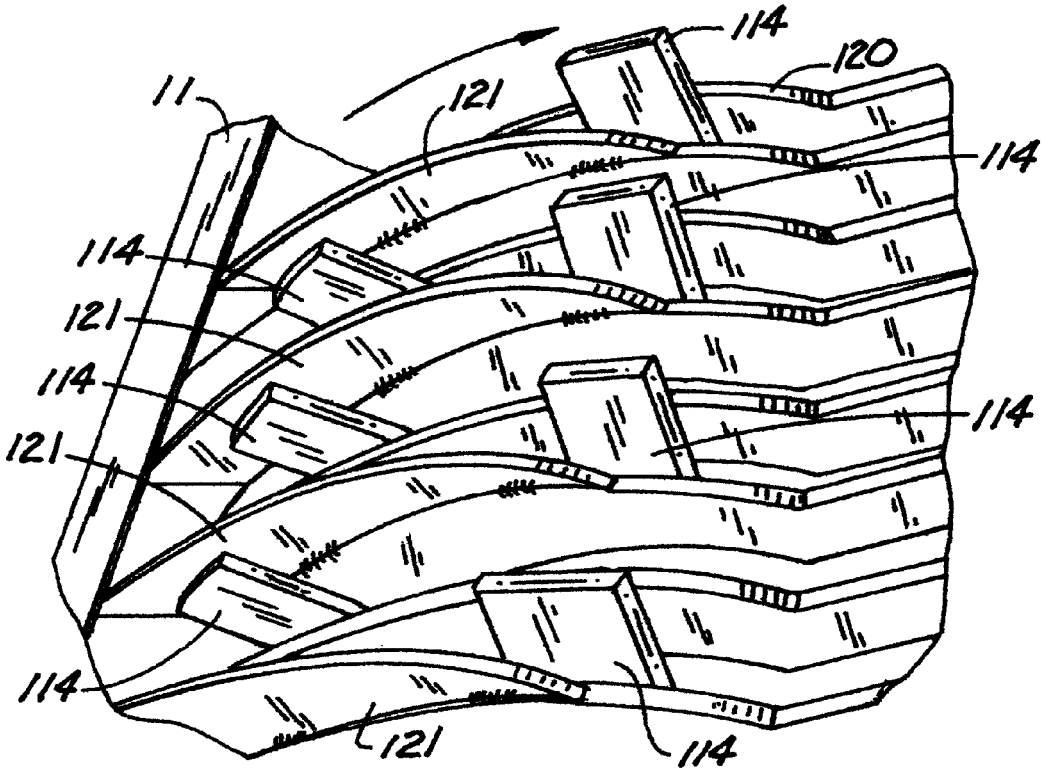
FIG. 5 is a perspective view of the embodiment of FIGS. 3 and 4B as would be seen if looking at a tub grinder from the view of FIG. 1 if it had the improvement of the present invention thereon.

FIG. 5 is a perspective view of the embodiment of FIGS. 3 and 4B as would be seen if looking at a tub grinder 10 from the view of FIG. 1 if it had the improvement of the present invention thereon. Slug bars 120 have riser bar portions 121 welded to the top thereof and the hammers 114 are shown passing between the slug bars 120 and riser bar portions 121 to gradually begin grinding material as the hammers 114 move to the right in the direction of the arrow shown in FIG. 5.

Figure 6:
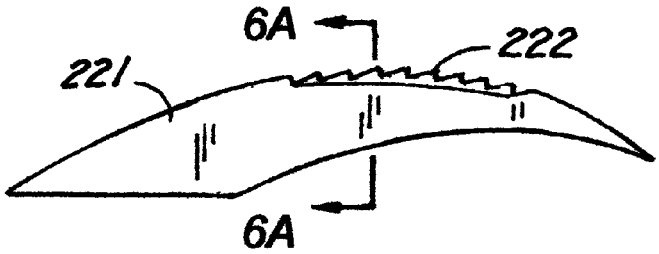
FIG. 6 is a side elevational view of a riser bar similar to the one shown in FIG. 3, but having a serrated and sharpened top surface on a part thereof.
Figure 6A:
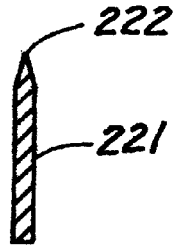
FIG. 6A is a cross sectional view taken along line 6A-6A of FIG. 6.

FIG. 6 is a side elevational view of a riser bar 221 similar to the riser bar 121 shown in FIG. 3, but having a serrated and sharpened top surface 222 on a part thereof. FIG. 6A is a cross sectional view taken along line 6A-6A of FIG. 6 and shows how the serrated part 222 is also sharpened to an edge. Using this alternate embodiment will provide additional cutting action as the hammers 114 force the material against the sharpened serrated edge 222.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept as expressed by the attached claims.

I claim:

1. A tub grinder comprising:

a frame;

a substantially horizontal floor operatively attached to the frame;

an opening disposed in the floor;

a circular wall operatively rotatably attached to the frame, the circular wall being disposed generally above the floor and encircling the floor so that when the circular all rotates material on the floor is moved in the same direction as the circular wall is moving;

a rotor operatively rotatably attached for rotation in a first direction relative to the frame about a longitudinal axis;

a plurality of slug bars operatively rigidly attached to the frame and extending across the opening in the floor, each of the slug bars having a top and a bottom, a first end and a second end, the slug bars have a thickness measured between a first side and a second side;

a plurality of riser bars rigidly attached to the top of respective slug bars, the riser bars extending vertically higher on the first end of the slug bar than on the second end of each respective slug bar, the riser bars have a thickness measured between a first side and a second side; and a plurality of hammers spaced apart and pivotally attached to the rotor, the hammers passing between adjacent slug bars as the rotor rotates in the first direction about the longitudinal axis, respective hammers entering a space between respective adjacent riser bars on the first end where the riser bars are vertically higher before the respective hammers enter the space on the second end where the respective adjacent riser bars are lower, the hammers extending farther vertically upwardly with respect to each of the respective adjacent riser bars on said second end of the riser bars than on the first end of the riser bars.

2. The tub grinder of claim 1 wherein the thickness of the riser bars is less than the thickness of the slug bars.

3. The tub grinder of claim 1 wherein the plurality of riser bars are welded to the slug bars.

4. The tub grinder of claim 1 wherein at least a portion of the top of the riser bars have a sharpened serrated edge.

5. A tub grinder comprising:

a frame;

a substantially horizontal floor operatively attached to the frame;

an opening disposed in the floor;

a circular wall operatively rotatably attached to the frame, the circular wall being disposed generally above the floor and encircling the floor so that when the circular wall rotates material on the floor is moved in the same direction as the circular wall is moving;

a rotor operatively rotatably attached for rotation in a first direction relative to the frame about a longitudinal axis;

a plurality of slug bars operatively rigidly attached to the frame and extending across the opening in the floor, each of the slug bars having a top portion and a bottom portion, a first end and a second end;

the plurality of slug bars have a riser bar portion disposed on the top of respective slug bars, the riser bar portions extending vertically higher on the first end of each respective slug bar than on the second end of each respective slug bar; and a plurality of hammers spaced apart and pivotally attached to the rotor, the hammers passing between respective adjacent slug bars as the rotor rotates in the first direction about the longitudinal axis, respective hammers entering a space between respective adjacent riser bar portions on the first end where the riser bar portions are vertically higher before the respective hammers enter the space on the second end where the respective adjacent riser bar portions are lower, the hammers extending farther vertically upwardly with respect to each of the respective adjacent riser bar portions on said second end of the riser bar portions than on the first end of the riser bar portions.

6. The tub grinder of claim 1 wherein at least a portion of the top of the riser bar portions have a sharpened serrated edge.

* * * * *